United States Patent [19]

Guptail

[11] 4,415,444

[45] Nov. 15, 1983

[54] AIR COOLING SYSTEM FOR A VIBRATORY SAND RECLAIMING APPARATUS

[75] Inventor: William G. Guptail, Barrington, Ill.

[73] Assignee: General Kinematics Corporation, Barrington, Ill.

[21] Appl. No.: 309,560

[22] Filed: Oct. 8, 1981

[51] Int. Cl.[3] ..... B07B 1/58

[52] U.S. Cl. ..... 209/3; 209/11; 209/238; 51/163.1; 34/20; 34/164; 164/269; 198/952

[58] Field of Search ..... 209/11, 3, 238, 466, 209/467, 471, 472, 502; 164/404, 269; 165/47, 53; 198/952; 51/163.1, 417, 422; 34/20, 57 C, 164, 170

[56] References Cited

U.S. PATENT DOCUMENTS

| | | | |
|---|---|---|---|
| 3,089,253 | 5/1963 | Evans | 209/466 X |
| 3,161,483 | 12/1964 | Morris | 209/466 X |
| 3,630,352 | 12/1971 | Morse | 209/11 |
| 3,745,667 | 7/1973 | Heinemann et al. | 34/20 |
| 3,827,159 | 8/1974 | Venanzetti | 34/164 |
| 4,025,419 | 5/1977 | Musschoot | 209/3 |

FOREIGN PATENT DOCUMENTS

| | | | |
|---|---|---|---|
| 991916 | 10/1951 | France | 34/170 |

*Primary Examiner*—Ralph J. Hill

*Attorney, Agent, or Firm*—Wood, Dalton, Phillips, Mason & Rowe

[57] ABSTRACT

Cooling air is introduced into the vibrating chamber of a sand reclaiming apparatus. A plurality of hollow inverted V-shaped ribs, extending longitudinally along the floor of the chamber distribute the air from an external source over the bottom region of the chamber. A gap is included between the lower edges of the ribs and the chamber floor. The air traveling within the hollow of the ribs is expanded about the lower edges of the ribs and directed upwardly through the bonded sand particles to effect cooling.

6 Claims, 3 Drawing Figures

AIR COOLING SYSTEM FOR A VIBRATORY SAND RECLAIMING APPARATUS

BACKGROUND OF THE INVENTION

In foundry operations molten metal is often cast in a sand mold. To retain the shape of the mold, the sand is generally treated with a resin binder and may include embedded metal reinforcing cores or rods for additional strength. After completing the casting operation, the sand is reclaimable by an apparatus as disclosed in U.S. Pat. No. 3,793,780, issued to Albert Musschoot and entitled "Vibratory Casting Tumbling Apparatus" or by an apparatus disclosed in U.S. Pat. No. 4,025,419, issued to Albert Musschoot and entitled "Vibratory Sand Reclaiming Apparatus". In both Musschoot patents, sand lumps, which may still be at an elevated temperature, are introduced into a vibrating chamber where they are agitated and abrade each other to produce discrete sand particles. The sand and lumps, when processed in the apparatus of either U.S. Pat. No. 3,793,780 or 4,025,419, although cooled some, are still much too hot when discharged to be immediately reused. The sand can be cooled by dumping it in piles on the foundry floor which takes up space, takes time to cool and is needlessly messy. Additionally, the heat from the sand may severely stress welds as well as potentially damage the remainder of the structure including specifically the motors that impart the vibratory action to the chamber.

BRIEF SUMMARY OF THE INVENTION

The present invention introduces cooling air into the vibrating chamber of a sand reclaiming apparatus. Air is delivered through a conduit which communicates with a conducting means adjacent the lower region of the chamber. The conducting means distribute the air substantially over the bottom portion of the chamber from which the air is directed upwardly through the sand particles being reclaimed.

In one form of the vibratory sand reclaiming apparatus, a plurality of longitudinally extending substantially hollow ribs are included at the bottom of the chamber. The ribs, which are preferably an inverted V-shape in cross-section, confine lateral movement of the sand, thereby keeping the particles in contact with each other so as to enhance abrasion. Additionally the ribs afford a guiding means for the sand towards a discharge outlet.

In a preferred form of the invention, air is introduced through a conduit which communicates with the region at the underside of the ribs. The ribs, which are closed at either end, direct the air along the length of the chamber. One or more longitudinal gaps are included between the bottom edges of the ribs and the floor of the chamber. After the air fills the region beneath the ribs, the air flows through the gaps and about the bottom edges of the ribs so as to permeate the chamber.

It is the principal object of the present invention to cool the sand in the reclaiming apparatus to a temperature that allows using conventional material handling or processing equipment without concern for elevated sand temperatures and allows the sand to be immediately reused if desired.

It is another object of the present invention to lower the temperature of the contained sand so as to protect the sand reclaiming apparatus from excessive heat. This is most effectively accomplished by introducing the air at the region closest to the critical operating elements (i.e., motors, springs, etc.) so that the sand immediately thereabout will at all times be kept at a relatively safe temperature as dictated by the particular resistance of the elements.

BEST MODE FOR CARRYING OUT THE INVENTION

Figure 1:
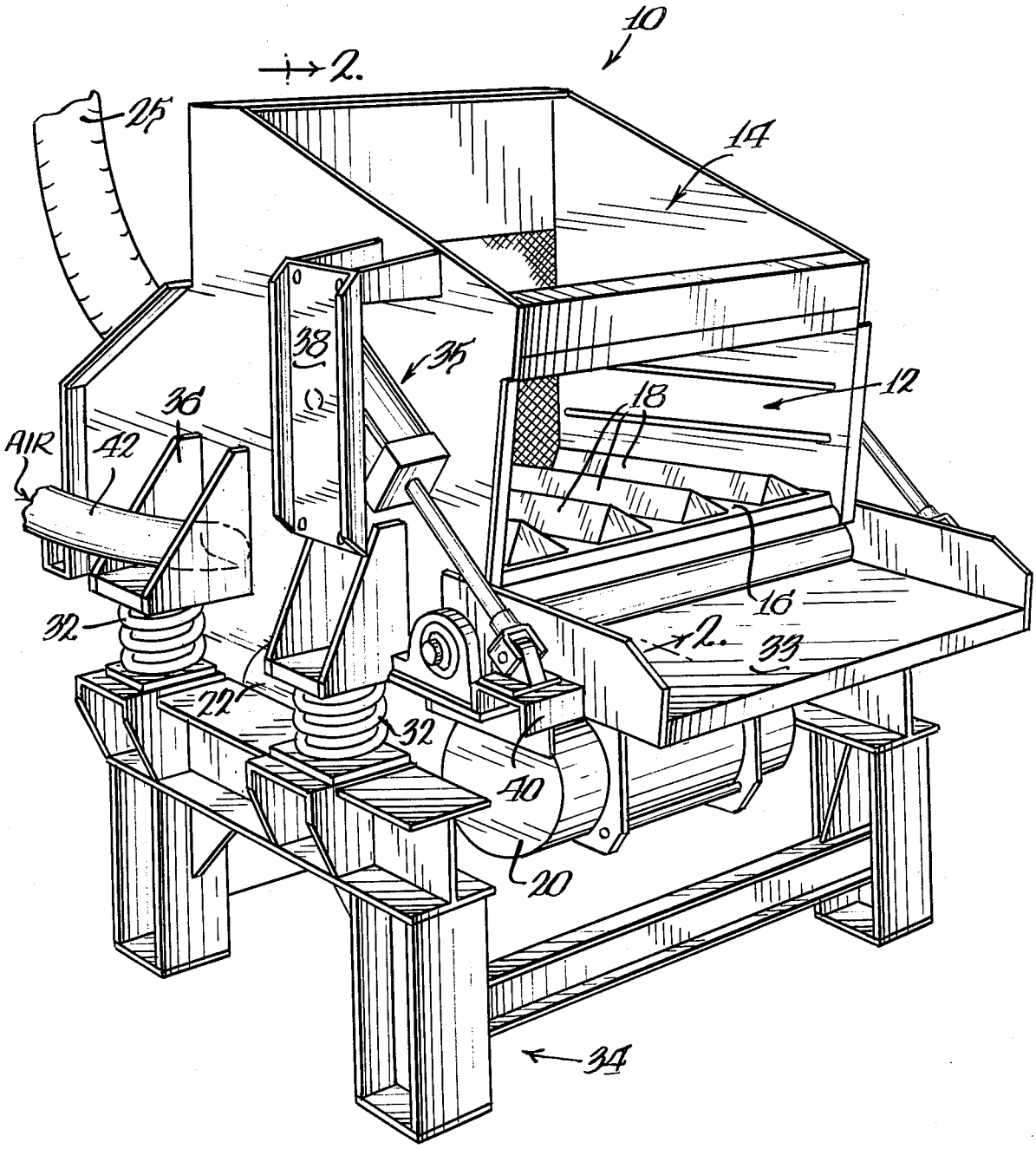
FIG. 1 is a perspective view of a vibratory sand reclaiming apparatus incorporating the air cooling system of the present invention.

Referring initially to FIG. 1 there is shown a vibratory sand reclaiming apparatus having a housing 10 and main chamber 12 associated therewith within which bonded sand particles are disposed. Access is had to the chamber through an opening 14 at the upper portion of the apparatus through which the material is introduced. The chamber 12 includes a floor 16 slanting downwardly towards the outlet end, to the left in FIG. 1, and a plurality of longitudinally extending ribs 18 extending substantially the length of the chamber.

Figure 2:
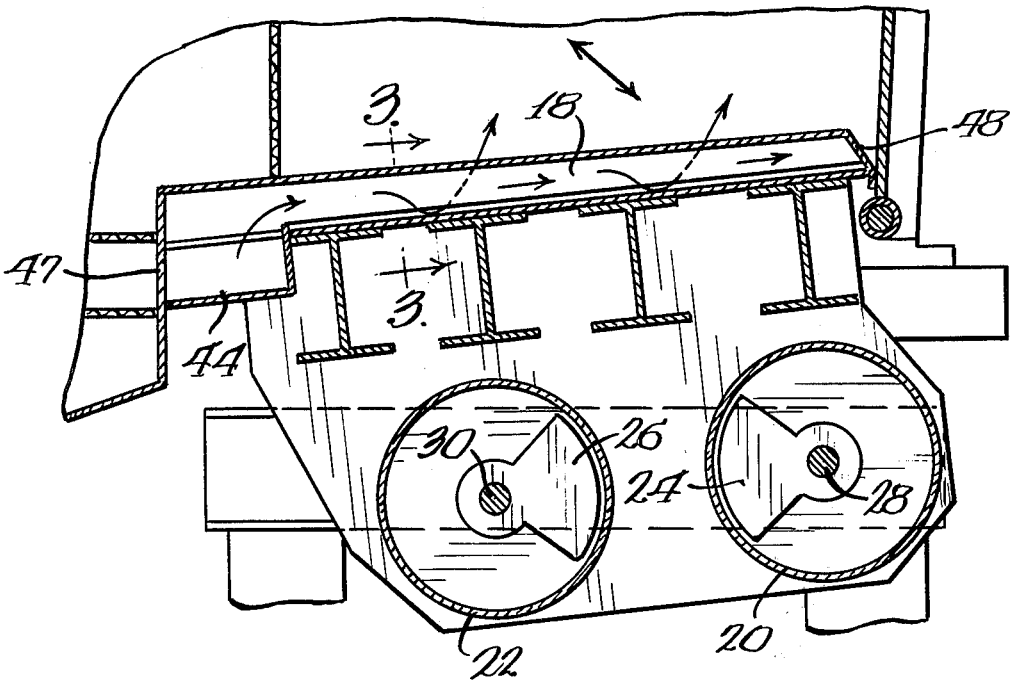
FIG. 2 is a fragmentary cross-sectional view along line 2—2 in FIG. 1.

A pair of motors 20,22 are secured to the underside of the housing. As seen in FIG. 2, eccentric weights 24,26 are carried at opposing ends of a shaft 28,30 provided with each motor. A similarly constructed third motor (not shown) is included at the upper region of the housing adjacent the outlet end.

The entire housing 10 is suspended for vibratory movement by a plurality of isolation springs 32 situated at each side of the housing. The springs are carried by a support stand 34 and engage a pair of brackets 36 mounted on the opposing sidewalls of the housing 10.

In operation, the sand lumps containing binders and coatings and including any material coming from a mold into which a casting has been poured, are introduced into the chamber at the opening 14. The motors 20,22 are then started to impart a vibratory movement to the housing and the lumps and material in the chamber are rubbed against one another to separate sand in the form of discrete particles from the binders, coatings and materials. The sand so removed builds up as a body of sand in the bottom of the chamber, and its accumulation, together with the vibratory movement which has a conveying action, moves the discrete or particulate sand particles toward the outlet end, where they are screened before they are discharged. An air sweep exhaust (not shown) operates at the outlet end to exhaust air born fines, including binders, clay or coatings, from the sand and from the outlet end. The fines are carried away through exhaust duct 25. The specific mechanism and the process through which the screening occurs does not form part of the present invention. The structure and operation of the vibratory reclaiming apparatus is taught in the Musschoot patents previously referred to.

After some period of use there will be an accumulation of material at the bottom of the chamber, for example, metal rods, cores and large irreducible lumps of sand. To remove this material, a pivotally secured gate 33 at the end opposite the outlet is moved to its fully open or horizontal position as depicted in FIG. 1. Movement of the gate is accomplished by a pair of air operated actuators 35 pivotally secured at their opposing ends to a pair of brackets 38 on the housing and a laterally directed extension 40 of the gate. Either of the two motors 20,22 may then be stopped and the third motor (not shown) started. The operation of the third motor in conjunction with one of the motors 20,22 will cause a vibratory conveying action away from the sand outlet end so that the material will be delivered to the horizontally disposed gate 33 from which they are easily removable.

To cool the chamber as proposed in the present invention, air is introduced through the sidewall of the housing 10. An air supply line 42 feeds a laterally extending rectangular conduit 44 disposed immediately beneath the chamber floor adjacent the outlet end of the chamber. The conduit 44 spans substantially the entire width of the chamber so as to intersect the floor region occupied by the ribs. A plurality of apertures are included in the floor so as to admit air from the conduit into a hollow V-shaped channel 46 defined beneath each of the ribs. An end closure 48 is included at the end of the channel closest to the inlet while the opposing ends of the ribs are integrally formed with a wall 47, preceding the screening section of the apparatus, so as to provide a suitable closure.

Figure 3:
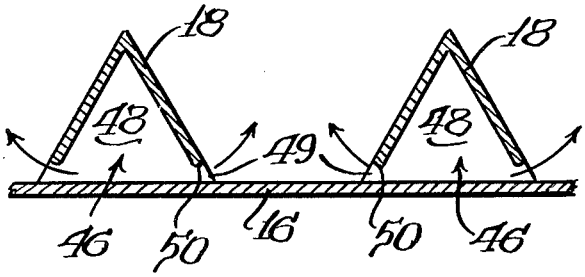
FIG. 3 is an enlarged fragmentary cross-sectional view along line 3—3 of FIG. 2.

The ribs 18 are constructed so that a longitudinal gap 49 is included between the bottom edges 50 of the ribs and the floor surface between the conduit 44 and the end closure 48. Each gap 49 may be one elongate gap or it may comprise a plurality of aligned discrete gaps separated by short segments of the ribs acting as supports therebetween. The air, which follows the path of the arrows in FIG. 2, fills the region beneath the ribs after which it flows outwardly from beneath the edges 50 of the ribs 18 as illustrated by the arrows in FIG. 3 and upwardly so as to permeate the chamber. The heated air is ultimately expelled through the access opening 14. The air preferably originates from immediately adjacent the floor so as to protect the motors and mechanism situated proximately therebelow. This is important in that the heated molds may be introduced to the apparatus at temperatures in excess of 1000° F.

The sand thus treated will exit the apparatus at the outlet end at a lowered temperature such that conventional material handling or processing equipment can be used to convey the sand either to a storage area or to an area ready for immediate reuse. Fines including the binders, clays and/or coatings are drawn from the sand at the outlet end as the sand exits the chamber.

I claim:

1. In a vibratory material treatment device having a U-shaped hopper at least partially tipped to one side thereof and adapted to receive material to be treated along said side, a first eccentric weight and motor set located on one side of the center of gravity of the hopper and operable for applying a first vibratory force to said hopper in a direction such that the material will advance from said one side toward the base of the hopper; a second eccentric weight and motor set located on the other side of the center of gravity of the hopper and operable for applying a second vibratory force to said hopper in a direction such that the resultant force from said first and second forces will advance material longitudinally from said base toward said side and out of said hopper; the improvement comprising a plurality of substantially hollow longitudinally extending conducting means situated adjacent the lower region of said chamber, each defining in conjunction with the chamber a substantially closed conduit; means communicating air under pressure from an external supply to said conducting means and filling the conduits; and means associated with said conducting means for distributing air under pressure from the conduits into the chamber for cooling the heated sand as it is reduced from lumps to particles of sand.

2. The apparatus of claim 1 wherein a gap is included between said conducting means and the bottom of said chamber through which gap air under pressure is admitted into the chamber.

3. The apparatus of claim 1 wherein said conducting means comprise a plurality of longitudinally extending ribs which are closed adjacent their opposing ends to prevent the escape of air at the ends and to thereby cause a greater buildup of pressure to occur in each conduit to enhance air distribution in the chamber.

4. In an apparatus for cooling and reclaiming foundry sand from mold materials and lumps of previously used heated foundry sand containing binders and coatings comprising:

means forming a substantially closed chamber; and means for vibrating said chamber to agitate the heated lumps of sand, binders and materials and cause them to abrade each other to remove discrete particles of sand therefrom, the improvement comprising:

a plurality of longitudinally extending, substantially closed, hollow ribs which are of a substantially inverted V-shape in cross-section adjacent the bottom region of the chamber;

sand ribs confining lateral movement of the heated lumps of sand and maintaining the heated lumps of sand in contact with each other to enhance abrasion;

means communicating air under pressure between an external supply and the hollow portion of said ribs; and means for communicating air between said ribs and the chamber along a length thereof for cooling said heated sand and said materials.

5. In an apparatus as claimed in claim 4 wherein said means for communicating air under pressure comprises at least one slot near the base of said ribs.

6. In an apparatus as claimed in claim 4 wherein said means for communicating air under pressure into said chamber comprises a plurality of slots at the junction between said ribs and the bottom of said chamber.

* * * * *